United States Patent [19]

Bente

[11] 4,414,763

[45] Nov. 15, 1983

[54] SOLE FOR A SPORTS SHOE OR BOOT

[75] Inventor: Alfred Bente, Herzogenaurach, Fed. Rep. of Germany

[73] Assignee: Messrs. Adidas Sportschuhfabriken Adi Dassker KG, Fed. Rep. of Germany

[21] Appl. No.: 419,909

[22] Filed: Sep. 20, 1982

[30] Foreign Application Priority Data

Apr. 7, 1982 [DE] Fed. Rep. of Germany ..... 3212980

[51] Int. Cl.[3] ..... A43C 15/02

[52] U.S. Cl. ..... 36/134; 36/67 R; 36/67 D; 36/59 R

[58] Field of Search ..... 36/59 R, 59 A, 61, 62, 36/66, 67 R, 67 A, 67 D, 134, 124, 64

[56] References Cited

U.S. PATENT DOCUMENTS 2,607,134 8/1952 Langer ..... 36/67 D
2,911,738 11/1959 Clerke ..... 36/134
3,321,850 5/1967 Coker et al. ..... 36/67 A
4,035,934 7/1977 Hrivnak ..... 36/134

OTHER PUBLICATIONS

Offenlegungsschrift 2733846, Germany 2/1979, Moller.
Offenlegungsschrift 2154951, Germany 5/1973, Toth et al.

*Primary Examiner*—Werner H. Schroeder

[57] ABSTRACT

A sole for a sports shoe comprises a plurality of fixing protrusions projecting from the underside of the sole, and a sleeve member which is fitted over each protrusion. The protrusion has a shoulder defining a retaining surface engaged by latching hooks on the sleeve member. In the engaged position of the latching hooks, a portion thereof still projects outwardly of the sleeve member. A cap-like member defining a gripping projection or stud is fitted over the sleeve member on each protrusion, and is engaged with the outwardly projecting portions of the latching hooks so as to be retained in place, while also securing the latching hooks engaged with the retaining surface of the shoulder.

10 Claims, 4 Drawing Figures

SOLE FOR A SPORTS SHOE OR BOOT

BACKGROUND OF THE INVENTION

The invention relates generally to sports shoes or boots such as football boots or the like, and more particularly to the sole for such a boot or shoe. For the sake of simplicity herein the term sports shoe will be used to cover any appropriate form of sports shoe, sports boot (being generally of a heavier construction than a sports shoe in the narrow sense) and the like.

Sports shoes are known, the soles of which have a plurality of ground-engaging or gripping portions or elements, for example up to around twenty thereof, being predominantly formed integrally with the sole. Because of the material used for forming the gripping elements or studs, they have a certain degree of resiliency and flexibility. Such soles are preferably used by sportsmen when the resilient deformability of the projections or studs formed by the gripping elements, which contrasts with the replaceable kind of stud which is usually hard, and the damping or shock-absorbing effect which results from such resiliency of the projections, is to be utilised. That applies in particular in regard to hard grounds and playing areas which nonetheless still require the use of gripping projections or studs in order to ensure a satisfactory grip when playing a game. In addition, sports shoes with soles having integral projections or studs of the above-indicated kind are also extensively used by footballers when training as they have been found for example to cause less injury.

A long-standing problem in regard to such sports shoe soles is that, once the gripping projections or studs are worn, the entire sole and thus the entire shoe can no longer be used, even if the upper portion of the shoe is still in satisfactory condition. In order to increase the service life of the sole of the shoe, so that it is at least approximately equivalent to that of the shoe in its entirety, the sole must be made from a plastic material which has a very high degree of resistance to wear. As that causes the cost of the sole to be increased, it has been suggested that the projections alone may be made from a wear-resistant material, and joined to the sole, which thus comprises a cheaper material, in the sole casting or moulding operation. However, that suffers from the disadvantage that the harder material of the projections or studs considerably reduces the degree of resiliency and damping effect which is precisely required of such studs or projections. Basically, that consideration also applies in regard to projection-bearing soles for sports shoes, wherein the projections or studs are formed by cap members of wear-resistant material which can be secured by screwing to securing projections or fitments on the sole, having a male screwthread for securing the cap in position (see French patent specification No. 2 070 253). However, a disadvantage in such an arrangement is that the fixing fitments often suffer irrepairable damage if the person using the sports shoes does not replace the caps in good time, before at least the ground-engaging part of the projection caps is completely worn out.

SUMMARY OF THE INVENTION

An object of the present invention is therefore to provide a sole with studs, projections or the like, which does not suffer from the above-indicated disadvantages.

Another object of the invention is to provide such a sole comprising a main portion made of a comparatively inexpensive material, and replaceable studs, projections or the like gripping elements thereof, of a highly wear-resistant material, without losing the damping or cushioning effect of the studs, projections or the like.

Still another object of the present invention is to provide a sports shoe sole having projections or gripping elements on the underside thereof, such that excessive wear of the studs of gripping elements, through such wear going unnoticed, does not render the fixing fitments on the sole useless.

In accordance with the present invention, these and other objects are achieved by a sole for a sports shoe such as a football shoe or boot, comprising fixing protrusions which project from the underside of the sole, for replaceably mount thereon stud-like members, projections or like gripping elements which are of a generally cup-shaped configuration. Each fixing protrusion has a shoulder configuration forming a retaining surface which faces towards the adjoining underneath surface of the sole. A sleeve member can be pushed on to the fixing protrusion, and is retained thereon by at least one hook member formed on the sleeve member engaging behind the shoulder on the fixing protrusion. The hook member is movable in a suitable opening in the side wall portion of the sleeve member. A ground-engaging stud, projection or the like can then be fitted on to the sleeve, whereupon the hook member projects outwardly slightly beyond the edge of the above-mentioned opening in the side wall portion of the sleeve member, and is thereby in frictional contact with the inside surface of the ground-engaging projection member or the like which is fitted on to the sleeve, thereby to retain it in place thereon.

Therefore, the sole in accordance with the invention has fixing protrusions which are not in the form of a screw fitment with a male screwthread, but which are simply of a configuration such as to define a shoulder which faces towards the underside surface of the sole, at a given spacing from the free end of the fixing protrusion, that is to say, between the free end of the protrusion and the main portion of the sole. The gripping projection members, stud members or the like which simply form a shell member of cap-like or thimble-like configuration, comprising a strong plastic material, are secured to the respective fixing protrusion by means of the sleeve which is retained to the shoulder at the inside surface thereof by means of the hook member, that is to say, by a form-locking or positive engagement. At its outside surface however, the projection shell member is secured in position by a press fit or a corresponding frictional fit, by virtue of the hook portion which projects slightly beyond the outside surface of the sleeve. The shell member itself ensures that the hook portion cannot move out of form-locking engagement with the shoulder, by moving through the opening in the wall portion of the sleeve, so that, without removing the gripping projection shell member from the sleeve, the sleeve cannot be removed from the fixing protrusion. The outside surface of the stud or shell member may be provided with gripping surfaces which, by applying a tool thereto, permit the member to be pulled off, thereby overcoming the frictional lock to the sleeve. That is necessary when the ground-engaging surface of the shell member is worn to such a severe extent that there is a danger of damaging the fixing protrusion on which it is fitted. Nonetheless, it might be noted that such damage to the free end of the fixing protrusion is generally not critical because the shoulder which produces the holding effect is only disposed at a certain spacing from the free end of the protrusion, so that even a certain amount of wear on the fixing protrusion will not detrimentally affect the function thereof. Wear of the sleeve itself does not give rise to any problem as the sleeve, like the shell member itself, can be easily replaced.

In the sole according to the invention, the main body portion of the sole including the fixing protrusions which are integral therewith desirably comprises a plastic material which is comparatively soft and which is consequently not particularly resistant to wear, for example PVC. The gripping projections or shell members forming the outer part of the gripping projections, and desirably also the sleeve members, in contrast comprise a plastic material for example a polyurethane which has a very high level of resistance to wear. As the gripping projections or shell members only form an outer 'cover' for the fixing protrusions on the sole, the overall assembly of the projection and fixing protrusion retains the typical flexibility to be found in connection with the integral projections referred to above, with their desirable damping or cushioning action.

An advantageous feature of the invention provides that the fixing protrusions each project from the bottom of a shallow depression or recess in the underneath surface of the sole, with the gripping projection or shell member forming same being fitted to the sole with its edge fitting into the shallow depression. As the effect of such an arrangement is that forces acting parallel to the sole on the gripping projections are not carried and resisted solely by the fixing protrusions but also by the edges of the depressions which thus support the edges of the ground-engaging projections or shell members, the frictional connection between the shell members and the sleeve members may be lower in its gripping strength, which contributes to the components being easier to pull off, if required.

The fixing protrusions on the sole, for mounting the ground-engaging projections or like stud members, instead of being formed integrally with the main body portion of the sole, may also be connected to the main body portion of the sole, by being embedded and anchored therein by means of a fixing plate. That arrangement makes it possible for the fixing protrusions to be of a material which is also different from that forming the main portion of the sole, with the material for the fixing protrusions being in particular of a resiliently yielding nature in order thereby to compensate for any reduced mobility and flexibility of the ground-engaging projections or stud members, by virtue of their being made of a harder material.

Further objects, features and advantages of a construction in accordance with the principles of the present invention will be apparent from the following description and claims, and the accompanying drawings.

DESCRIPTION OF THE PREFERRED EMBODIMENT

Figure 3:
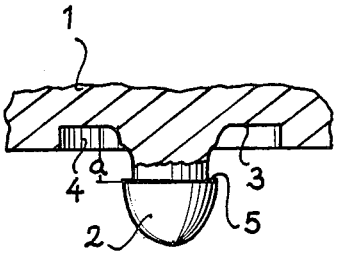
FIG. 3 shows a partly sectional view of a small portion of a sole according to the invention, in the region of a fixing protrusion for securing the FIG. 1 member in place.

Referring therefore now to the drawing for a description of a preferred construction in accordance with the invention, shown in exploded view therein, an outer sole 1 of which only part is shown in FIG. 3 and which comprises a suitable material such as a flexible plastic material such as PVC has a plurality, such as twenty, fixing protrusions or fitments 2 which are formed integrally with the body portion of the sole, at suitable spacings thereon. Each fitment 2 projects from the bottom 3 of a shallow circular depression or recess 4 provided in the surface of the sole 1, and is for example 10 mm in length. Approximately at a halfway position on its length, each fixing protrusion or fitment 2 has a shoulder 5 which defines a surface portion which faces towards the sole 1 and more particularly the bottom 3 of the depression 4 therein. In the illustrated embodiment, the shoulder 5 is of a circular configuration, corresponding to the circular cross-sectional shape of the fixing protrusion 2. The distance between the above-mentioned surface portion formed by the shoulder 5 and the bottom surface 3 of the depression 4 is indicated by a in FIG. 3.

Referring now also to FIGS. *2a* and *2b*, a sleeve member which is generally indicated by reference numeral 6 and which may also comprise a material such as PVC can be pushed on to the fixing protrusion or fitment 2. Formed integrally with the sleeve member 6 are diametrically oppositely disposed hook or latch elements 7 which extend from the lower edge (as viwed in FIG. *2a*) of a respective opening 8 which is formed in and extends entirely through the side wall portion of the sleeve member 6. In the rest condition of the component, the latch portions 7 project beyond the outside periphery of the sleeve member 6, as can be seen most clearly from FIG. *2a*. The latch portions 7 have hooking or latch surfaces 9 which, in the FIG. *2a* position, leave the interior of the sleeve member 6 totally free.

The inside diameter of the sleeve member is so adapted to the outside diameter of the fixing protrusion or fitment 2 in the region of the shoulder 5 and also at the base thereof, in the direct vicinity of the bottom 3 of the depression 4, in such a way that the sleeve member 6 can be pushed on to the fixing protrusion 2, possibly with a slight amount of clearance.

Figure 1:
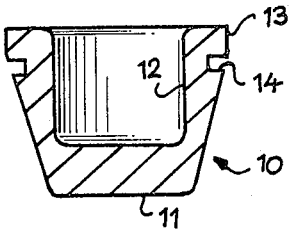
FIG. 1 shows a view in longitudinal section through a projection or projection-forming cap member, FIGS. *2a* and *2b* show a view in longitudinal section and an end view respectively of a sleeve member for securing the FIG. 1 cap to a fixing protrusion as shown in FIG. 3.

Referring now also to FIG. 1, the gripping projection or cap member 10 forming the outer part of the gripping projection is of an external frustoconical configuration having a ground-engaging surface 11, which therefore forms the end surface of the gripping projection or stud, and a smooth-walled cylindrical aperture or recess 12 in its interior. The diameter or corresponding transverse dimension of the aperture 12 is slightly greater than the outside diameter of the sleeve member 6. In the vicinity of the upper end as shown in FIG. 1, the member 10 is of a cylindrical configuration, over a region 13 which approximately corresponds to the depth of the depression or recess 4 in the surface of the sole, and is adapted in outside diameter to the diameter of the recess or depression 4. Disposed below the cylindrical region 13 is a peripheral annular groove 14 to act as a gripping surface for engaging a tool therein, for pulling off the member 10.

Figure 2A:
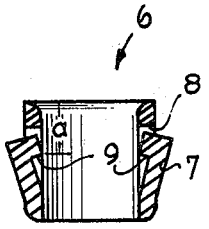
Figure 2B:
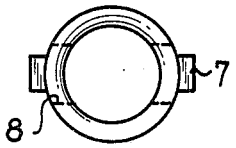

The method of assembly of the components shown in the drawings and described hereinbefore is as follows:

For fixing the member 10 to the fixing protrusion 2, the sleeve member 6 is first pushed on to the fixing protrusion 2 until the edge of the sleeve member 6 which is the upper edge in FIG. 2*a* bears against the surface 3 in the depression 4. In that position, the latch surfaces 9 of the latch portions 7 are disposed substantially precisely at the level of the shoulder 5, but do not engage behind the shoulder 5 as they are still disposed within the opening 8, that is to say, in the rest or non-loaded position shown in FIG. 2*a*. The spacing of the latch surfaces 9 from the upper edge of the sleeve member 6 thus corresponds to the spacing a of the shoulder 5 from the surface 3.

If now the member 10 is pushed on to the fixing protrusion 2 or more particularly on to the sleeve member 6 which is already disposed thereupon, then the latch portions 7 are pivoted inwardly through the associated openings 8 in the wall portion of the sleeve member 6 so that the latch surfaces 9 of the portions 7 engage behind the shoulder on the fixing protrusion 2. As however the radial extent of the latch portions, as measured relative to the longitudinal centre line of the sleeve member 6, is slightly greater than the annular width of the shoulder 5 and the thickness of the wall portion of the sleeve member 6 in combination, the radially inward ends of the latch portions 7 bear against the outside surface of the fixing protrusion 2, while they also project slightly beyond the outside surface of the sleeve member 6. Therefore, the member 10 can be pushed further on to the sleeve member 6, only if the latch portions 7 and/or the inner wall of the member 10 experience a certain amount of local resilient deformation. That causes a high degree of frictional lock to be produced between the inside wall portion of the member 10 and at least the latch portions 7, and possibly also a part of the outside surface of the sleeve member 6, adjoining the latch portions 7. The above-mentioned frictional lock causes the member 10 to be fixedly joined to the sleeve member 6. As the sleeve member 6 is in turn form-lockingly or positively retained to the shoulder 5 by the latch portions 7 engaging thereagainst, the gripping projection or stud member formed by the outer portion 10 can only be removed from the fixing protrusion 2 if the member 10 is first pulled off the sleeve member 6 again, for example by applying a pulling force which at least corresponds to the pressing force for forming the assembly. The relationships between the various dimensions of the aperture or recess 12 within the member 10 and the latch portions 7, as referred to above, are such that the force required for pulling the member 10 off the protrusion 2 is in any event considerably higher than the force which is to be expected, in the longitudinal direction of the fixing protrusion 2, when the sports shoe is in use. This means that, although the gripping stud or projection member 10 is replaceable, it is connected to the fixing protrusion 2 in such a way that it cannot come loose of its own accord. As the fixing fitment 2 and also the sleeve member 6 have the same resilient flexibility as the material forming the body portion of the sole, and as the member 10 which preferably comprises a wear-resistant polyurethane cannot compensate that flexibility, the above-described arrangement provides a gripping projection-bearing sole with the gripping projections or studs thereon having the typical degree of flexibility found in such studs or projections in a conventional sports shoe, except that the gripping projections or stud members are replaceable once they are worn.

As already mentioned, a particular advantage of the construction described and illustrated hereinbefore is that, once the surface 11 at least of the member 10 has been worn to such an extent that the aperture or recess 12 therein is exposed, although there is then the danger that the free end of the fixing protrusion 2 may also suffer damage, because the shoulder 5 is at a considerable distance from the free end of the protrusion 2, such damage to the protrusion 2 does not result in the protrusion 2 being rendered unusable. In addition, the firmness of the fit of a new member 10 and possibly sleeve member 6 on the fixing protrusion is not detrimentally affected thereby, as the sleeve member 6 is supported in the region of the shoulder 5 and in the vicinity of the bottom surface 3.

In order to ensure that the latch surfaces 9 of the latch portions or elements 7 are always at the desired distance a from the bottom 3 of the depression 4 in the body portion of the sole 1, it is possible to envisage the upper end of the sleeve member 6, as shown in FIG. 2*a*, being of a thin terminal configuration, being illustrated with a curved taper on the inner surface of the upper end portion, so that the upper end of the sleeve member 6 can therefore be easily deformable, and in addition the spacing between the upper end surface of the sleeve member 6 as shown in FIG. 2*a* and the latch surfaces 9 may be so defined that it is never less than the spacing a between the shoulder 5 and the surface 3. By virtue of that arrangement, when the member 10 is pushed on to the protrusion 2, the above-mentioned upper end surface of the sleeve member 6 is slightly resiliently upset against the surface 3 so that the latch portions 7, when engaged with the surface of the shoulder 5, apply a slight prestressing which contributes to holding the assembly together.

Various other modifications and alterations may be made in the above-described embodiment of the invention without thereby departing from the spirit and scope thereof. It should be appreciated that, although the projection or stud construction illustrated in the drawings is of a generally round and thus typical stud-like configuration, ground-engaging or gripping projections of a different configuration from the one illustrated may be employed without thereby departing from the spirit of the invention, for example projections of a generally short bar-like configuration, and the like. The various components of the arrangement may also be made of any other suitable materials which fulfil the requirements to be made in respect of the various components of the arrangement, such as satisfactory wear resistance for the member 10, while giving a suitable cushioning effect for the person wearing the shoe incorporating the sole and projection arrangement described, for example when using the shoe on hard playing surfaces. Furthermore, instead of the fixing protrusions for receiving the sleeve member 6 and the cap member 10 being formed integrally with the body portion of the sole 1, as described hereinbefore, the respective fixing protrusions may be joined to the sole 1, for example in the course of the sole moulding operation, by being mounted on a fixing plate which is embedded in and anchored to the sole.

What is claimed is:

1. A sole for a sports shoe comprising: fixing protrusions which project from the underside of the sole, each fixing protrusion comprising a shoulder facing towards the underside of the sole; a sleeve member adapted to be fitted on to each fixing protrusion and comprising a wall portion which in the fixed position is disposed around said fixing protrusion, said wall portion having at least one opening therein, and a latching means disposed movably in said at least one opening and adapted in an operative position to engage behind said shoulder on the respective fixing protrusion, with a portion of said latching means still projecting outwardly of said opening; and a ground engaging projection member adapted to be fitted over each said sleeve member and in frictional engagement with said outwardly projecting portion of said latching means.

2. A sole as set forth in claim 1 wherein each said latching means comprises a latching member pivotally mounted to said sleeve member.

3. A sole as set forth in claim 1 wherein each said latching means is formed integrally with said sleeve member and is disposed outside the inside surface of said wall portion of the sleeve member, in a rest position of the latching means.

4. A sole as set forth in claim 1 wherein said sleeve member has two oppositely disposed said latching means.

5. A sole as set forth in claim 1 wherein each said fixing protrusion projects from the bottom surface of a shallow depression in the underside of the sole, and wherein an edge portion of the respective projection member fits into the respective depression when fitted over the respective sleeve member.

6. A sole as set forth in claim 1 wherein each said projection member is provided with gripping means on the exterior thereof, for applying a tool for pulling off the projection member.

7. In a sports shoe, a sole comprising: a plurality of mounting protrusions projecting from the underneath surface of the sole, each mounting protrusion having a shoulder portion which faces towards the underneath surface of the sole and which is at least substantially normal to the direction of projection of the respective mounting protrusion; a sleeve member adapted to be fitted over each said mounting protrusion, each sleeve member comprising a peripheral wall portion having first and second openings therethrough and respective latching members disposed movably in each of said openings and movable between an inoperative position in which the latching means are disposed at least substantially outside the inside surface of said wall portion and an operative position of projecting inwardly of said inside surface, thereby latchingly to engage with said shoulder on the respective fixing protrusion, with a portion of the latching means still projecting outwardly of the respective openings; and a cap member adapted to be fitted over each said sleeve member thereby to provide a gripping projection member on the sole, the cap member being in frictional engagement with said outwardly projecting portions of said latching means thereby to hold said latching means in latching engagement with said shoulder.

8. A sports shoe as set forth in claim 7 wherein each said fixing protrusion has a rounded end portion at an end thereof remote from the underneath surface of the sole.

9. A sports shoe as set forth in claim 7 wherein each said fixing protrusion is encircled by a depression adapted to receive an adjoining edge portion of the respective projection member, thereby to enhance lateral location of said projection member relative to said sole.

10. A sports shoe as set forth in claim 7 wherein each said latching means comprises a limb portion having a first end integrally formed with an edge of the respective opening in the wall portion of the sleeve member, and a second end, and a latching portion on said second end, defining a generally hook-like configuration adapted to engage behind said shoulder portion.

* * * * *